US009320334B2

(12) United States Patent
Wilson-Thompson

(10) Patent No.: US 9,320,334 B2
(45) Date of Patent: Apr. 26, 2016

(54) HAIR REMOVAL APPARATUS

(75) Inventor: Kathleen Wilson-Thompson, Chicago, IL (US)

(73) Assignee: SWEET TEA INNOVATIONS, LLC, Chicago, IL (US)

( * ) Notice: Subject to any disclaimer, the term of this patent is extended or adjusted under 35 U.S.C. 154(b) by 499 days.

(21) Appl. No.: 13/525,679

(22) Filed: Jun. 18, 2012

(65) Prior Publication Data

US 2012/0323260 A1 Dec. 20, 2012

Related U.S. Application Data

(60) Provisional application No. 61/497,566, filed on Jun. 16, 2011.

(51) Int. Cl.
*A45D 26/00* (2006.01)

(52) U.S. Cl.
CPC ..... *A45D 26/00* (2013.01); *A45D 26/0042* (2013.01)

(58) Field of Classification Search
CPC A45D 26/00; A45D 26/0042; A45D 26/0028
USPC ..... 606/133, 131, 211
See application file for complete search history.

(56) References Cited

U.S. PATENT DOCUMENTS

| | | | | |
|---|---|---|---|---|
| 1,588,387 | A | 6/1926 | Li et al. | |
| 4,923,463 | A | 5/1990 | Nussbaum | |
| 4,983,175 | A * | 1/1991 | Daar et al. | 606/133 |
| 5,643,287 | A | 7/1997 | Ahad | |
| 5,908,425 | A | 6/1999 | Adam | |
| 7,235,085 | B1 | 6/2007 | Tahir | |
| 2008/0287964 | A1 | 11/2008 | Sun et al. | |
| 2009/0030430 | A1 * | 1/2009 | Levi | 606/133 |
| 2013/0053869 | A1 * | 2/2013 | Shekalim | 606/133 |

FOREIGN PATENT DOCUMENTS

| | | |
|---|---|---|
| EP | 270222 | 6/1988 |
| EP | 360253 | 3/1990 |
| WO | 2006105011 | 10/2006 |

* cited by examiner

*Primary Examiner* — Sarah W Aleman
*Assistant Examiner* — Socrates L Boutsikaris
(74) *Attorney, Agent, or Firm* — Troutman Sanders LLP; Ryan A. Schneider; Benjamin C. Wiles

(57) ABSTRACT

A hair removal apparatus adapted to remove hair can be manually, electrically, or battery operated, and is configured to fit comfortably from various parts of the body utilizing a threading member. The hair removal apparatus within the palm of a user's hand such that the user may accurately guide the hair removal apparatus over the desired hair-removal region.

19 Claims, 4 Drawing Sheets

HAIR REMOVAL APPARATUS

CROSS-REFERENCE TO RELATED APPLICATIONS

This application claims priority to U.S. Provisional Patent Application 61/497,566, filed 16 Jun. 2011, the contents of which are hereby incorporated by reference in their entirety as if fully set forth below.

BACKGROUND

There are many techniques and devices used to facilitate hair removal. For example, hair can be plucked using a tweezing apparatus, which can be time consuming and painful. Hair can be removed via a waxing substance, which can also be painful and may cause infections as the warm temperature of the wax fosters bacteria growth. As another example, hair can be removed via razor shaving. Although not particularly painful, shaving often times results in small cuts in the skin, and only removes hair at the skin surface rather than the hair follicle root.

Hair threading is a hair removal technique that incorporates intertwined thread, wherein hair is removed at the intertwining region. Although hair threading is not a new technique, it is becoming more popular in the U.S. Hair threading is desirable because it removes hair from the root and does not utilize chemicals, commonly found in hair removal techniques, that may agitate the skin. It is thus desirable to create a hair removal apparatus that incorporates the threading technique, wherein a user can perform hair threading on his or herself, eliminating the need for a hair threading technician.

BRIEF SUMMARY

Briefly described, embodiments of the present invention relate to a hair removal apparatus adapted to quickly engage and remove hair.

The hair removal apparatus may comprise an elongated body having a first section, a middle section, and a second section; a cartridge defining an indented region, the cartridge housed in the middle section; a threading member partially wrapped around the indented region of the cartridge; and a plurality of threading fingers extending out of an open face of the second section, wherein the plurality of threading fingers accommodate the threading member.

The threading member may define a first main loop, a second main loop, and an intertwining section. The intertwining section may be intertwined about three times to create three substantially symmetrical ovals. The hair removal apparatus is battery, electrically, or manually propelled such that the intertwining section tightens and loosens, which consequently removes hair from a desired hair-removal region.

DETAILED DESCRIPTION

Figure 1:
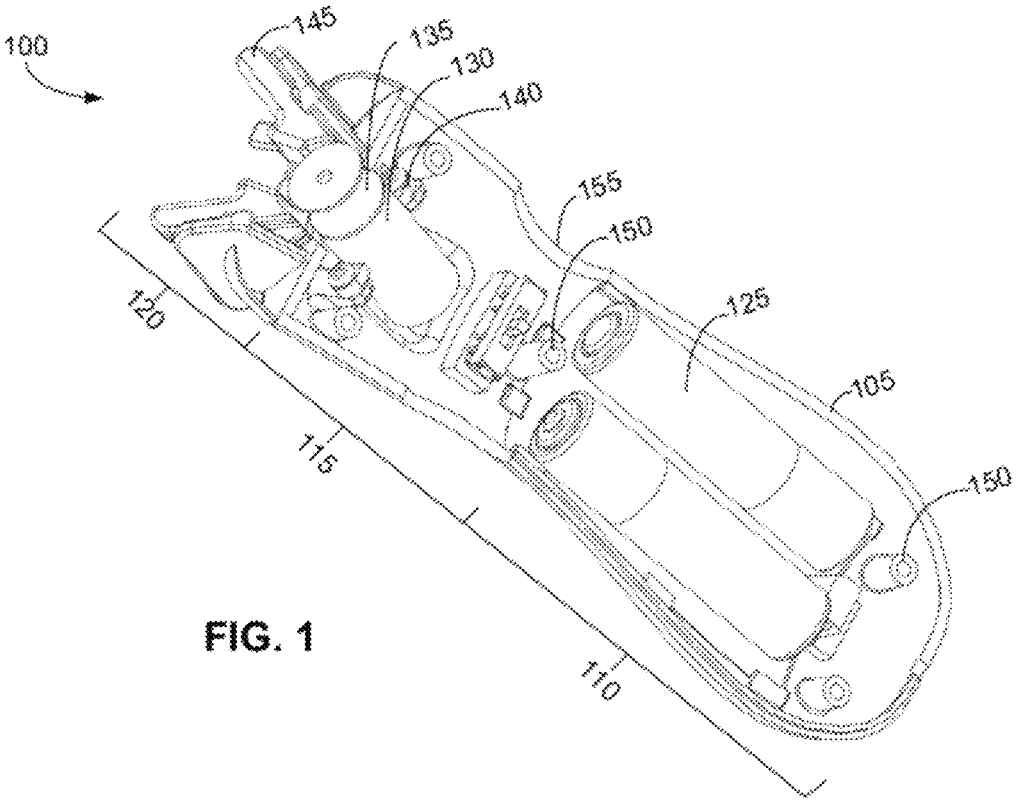
FIG. 1 illustrates a cross-sectional view of a hair removal apparatus, in accordance with exemplary embodiments of the present invention.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an," and "the" include plural referents unless the context clearly dictates otherwise.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Referring now to the drawings, in which like numerals represent like elements, exemplary embodiments of the present invention are herein described. It is to be understood that the figures and descriptions of the present invention have been simplified to illustrate elements that are relevant for a clear understanding of the present invention, while eliminating, for purposes of clarity, many other elements found in typical hair removal devices and methods of making and using the same. Those of ordinary skill in the art will recognize that other elements are desirable and/or required in order to implement the present invention. However, because such elements are well known in the art, and because they do not facilitate a better understanding of the present invention, a discussion of such elements is not provided herein.

The various embodiments of the present invention provide a hair removal apparatus adapted to remove hair utilizing a threading member from various parts of the body. It shall be understood that the hair removal apparatus can be manually, electrically, or battery operated, and is configured to fit comfortably within the palm of a user's hand such that the user may accurately guide the hair removal apparatus over the desired hair-removal region.

Referring to FIG. 1, there is shown a cross-sectional view of a hair removal apparatus 100, in accordance with exemplary embodiments of the present invention. The hair removal apparatus 100 comprises an elongated body 105. The elongated body 105 includes a first section 110, a middle section 115, and a second section 120 along its length. As illustrated, the first section 110 of the elongated body 105 may comprise a power supply 125 to propel a threading member, which will be further discussed herein. In exemplary embodiments, the power supply 125 may be made up of at least one battery; however the power supply 125 may comprise a plurality of batteries as well. The batteries may be disposable and/or rechargeable. Alternatively, the power supply may comprise electronic components as needed for electrical operation or manual components as needed for manual operation.

As illustrated, a cartridge 130 may be housed in the middle section 115 of the elongated body 105. In exemplary embodiments, the cartridge 130 is adapted to rotate about an axis aligned with the length of cartridge 130. As will be described, a threading member is secured around an indented region 135 of the cartridge 130. The rotation of the cartridge 130 (powered by the power supply 125) manipulates the threading member such that it engages and removes hair from a desired hair-removal region. The cartridge 130 is replaceable and may be snapped into place and secured by two securing elements 140 adjacent opposing sides of the cartridge 130. This configuration enables the cartridge 130 to be replaced as the user desires.

Figure 3:
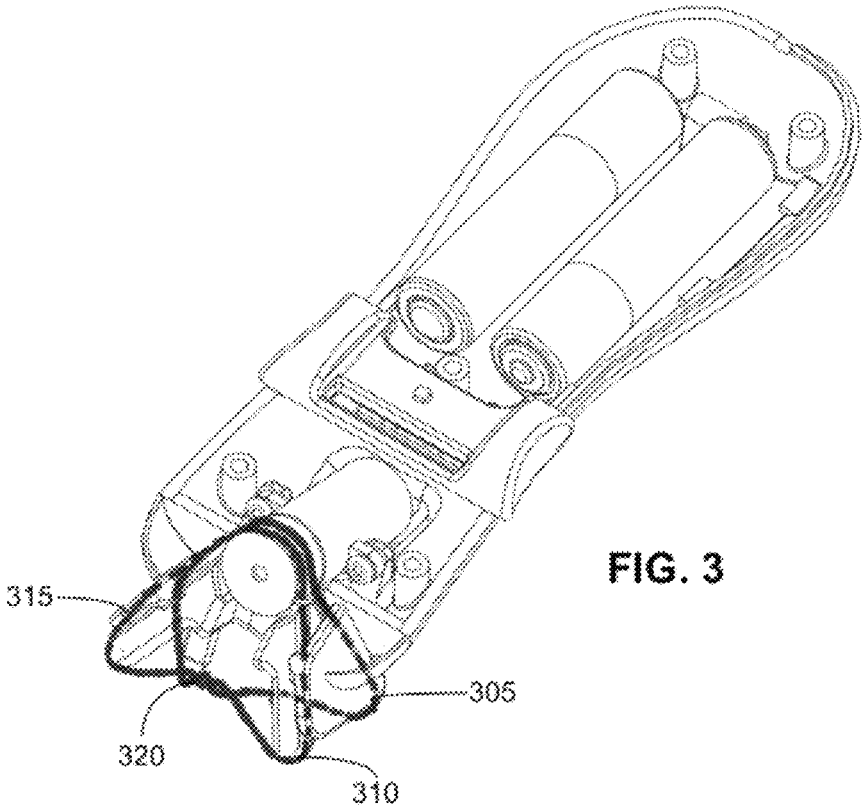
FIG. 3 illustrates yet another cross-sectional view of the hair removal apparatus comprising a threading member, in accordance with exemplary embodiments of the present invention.

Referring now to the second section 120, there is an open face comprising a plurality of threading fingers 145. The threading fingers 145 extend out of the open face of the second section 120 and are configured such that the threading fingers 145 accommodate the threading member 315, which is illustrated in FIG. 3. The threading fingers 145 are positioned such that they provide tension to the threading member 315. As illustrated in FIG. 3, the threading member 315 defines a first main loop 305, a second main loop 310, and an intertwining section 320. In an exemplary embodiment, the threading member 315 is intertwined approximately three times to create three substantially symmetrical ovals at the intertwining section 320. In other embodiments, however, the threading member 315 can be intertwined at least three times. Ultimately, the intertwining section 320 is the point of hair removal.

As described above, the threading member 315 propels around the indented region 135 of the cartridge 130, which is powered by the power supply 125. The continuous rotation of the threading member 315 propels the tightening and loosening of the threading member 315 at the intertwining section 320. This continuous motion enables the intertwining section 320 to engage and remove hair.

In exemplary embodiments, the threading member 315 of the present invention can be, for example but not limited to, plastic, rubber, cotton, silicon, or an admixture thereof. The first and second loops 305, 310 of the threading member 315 are continuous loops and therefore do not require the tying of knots around the string to complete the loops. In an exemplary embodiment, the threading member 315 can be coated with a soothing agent, for example but not limited to, aloe, to sooth the skin as the threading member 315 engages and removes hair. Although not illustrated, in some embodiments, the elongated body 105 can further comprise a cartridge containing a soothing agent, adapted to continuously release the soothing agent through an open face to protect the skin against irritation caused by hair removal.

Figure 2:
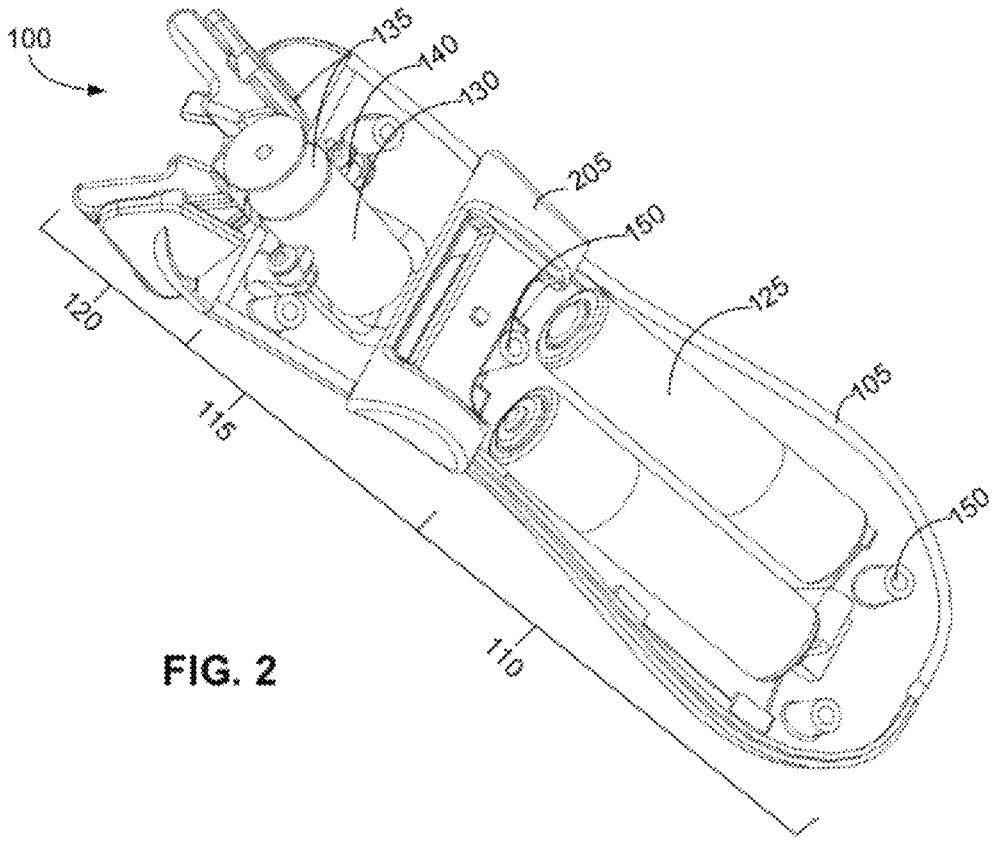
FIG. 2 illustrates another cross-sectional view of the hair removal apparatus, in accordance with exemplary embodiments of the present invention.

The first section 110, middle section 115, and second section 120 are substantially identical in circumference, however the middle section 115 can have an inwardly extending portion 155 adapted to cooperate with the palm of a hand to assist in the guidance of the hair removal apparatus 100. Further, and as illustrated in FIG. 2, the inwardly extending portion 155 may comprise an activating member 205 that extends from a first to a second side of the elongated body 105. The power supply 125 may be activated to the user's desire by manually depressing the activating member 205. In one embodiment, each depression of the activating member 205 may propel the threading member 315 around the first and second loops 305, 310 one time, thus enabling a user to tailor his or her hair removal needs. In another exemplary embodiment, one depression of the activating member 205 may continuously propel the threading member 315 and a subsequent depression of the activating member 205 may stop the threading member 315 (via turning the power supply 125 off). As described, the activating member 205 extends from a first to a second side of the elongated body 105. Alternatively, one side can be depressed to propel the threading member 315 and the opposite side can be depressed to stop the threading member 315. Alternatively, one side may be depressed to propel the threading member 315 a first direction, while the opposite side may be depressed to propel the threading member 315 in a second, opposite direction.

As illustrated in FIGS. 1 and 2, the elongated body 105 comprises a top half, illustrated in FIG. 1, and a bottom half, illustrated in FIG. 2. In an exemplary embodiment, the top half and the bottom half of the elongated body 105 engage each other such that they can be easily attached and detached from each other. This embodiment enables easy replacement of the interior components, therefore enhancing the reusable nature of the hair removal apparatus 100. Each half comprises mating elements 150 that may be snap-fit or press-fit together. In another exemplary embodiment, the top half and the bottom half of the elongated body may be permanently engaged, therefore substantially limiting their separation.

Figure 4:
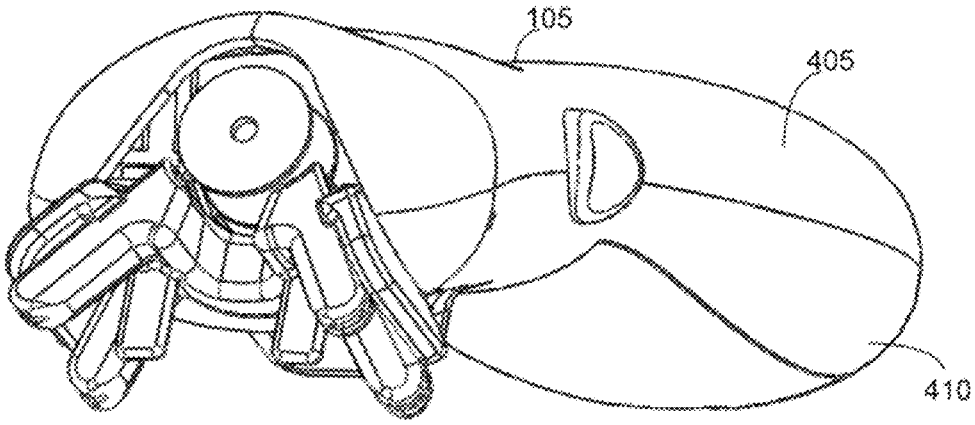
FIG. 4 illustrates a front view of the hair removal apparatus, in accordance with exemplary embodiments of the present invention.

Referring now to FIG. 4, there is shown a front view of the elongated body 105 in its enclosed form, wherein a top half 405 of the elongated body 105 is connected to a bottom half 410 of the elongated body 105.

Figure 5:
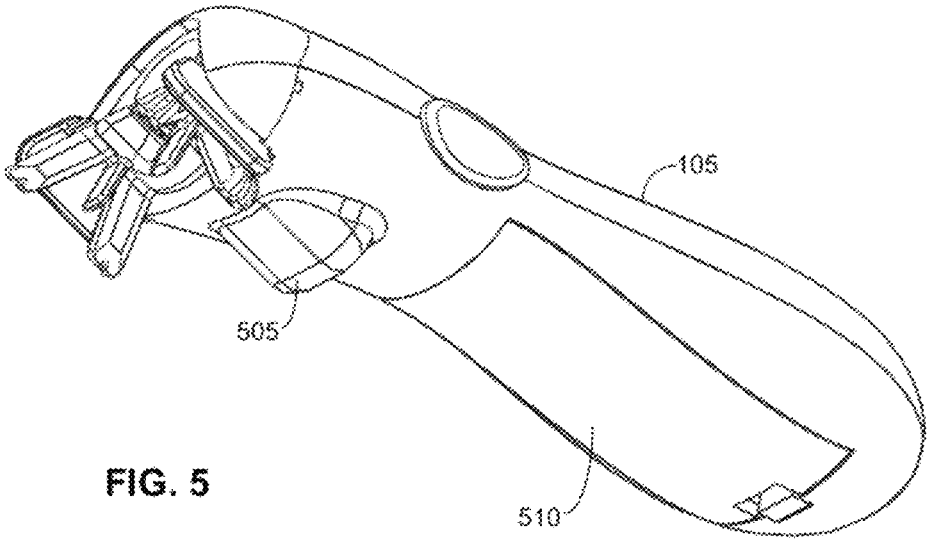
FIG. 5 illustrates an underside, partial perspective view of the hair removal apparatus, in accordance with exemplary embodiments of the present invention.
Figure 6:
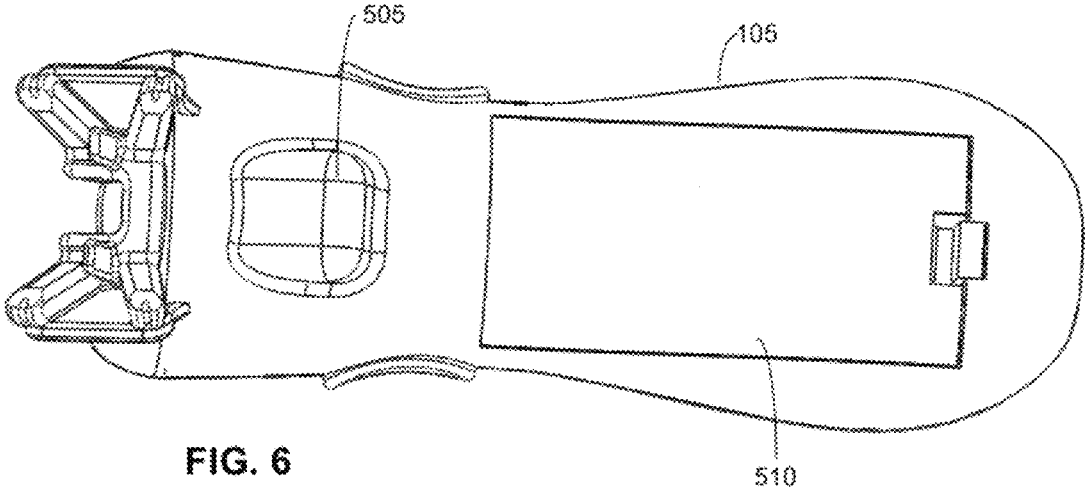
FIG. 6 illustrates an underside view of the hair removal apparatus, in accordance with exemplary embodiments of the present invention.

Referring now to FIGS. 5 and 6, there is shown underside views of the elongated body 105. As illustrated, exemplary embodiments may comprise a finger rest 505. The finger rest 505 enables a user to rest a finger (e.g. a forefinger) against the finger rest 505 to facilitate the safe and accurate guiding of the hair removal apparatus 100 along the hair removal region. Also illustrated, is a power supply cover 510 configured to house the power supply 125 illustrated in FIGS. 1, 2, and 3.

Figure 7:
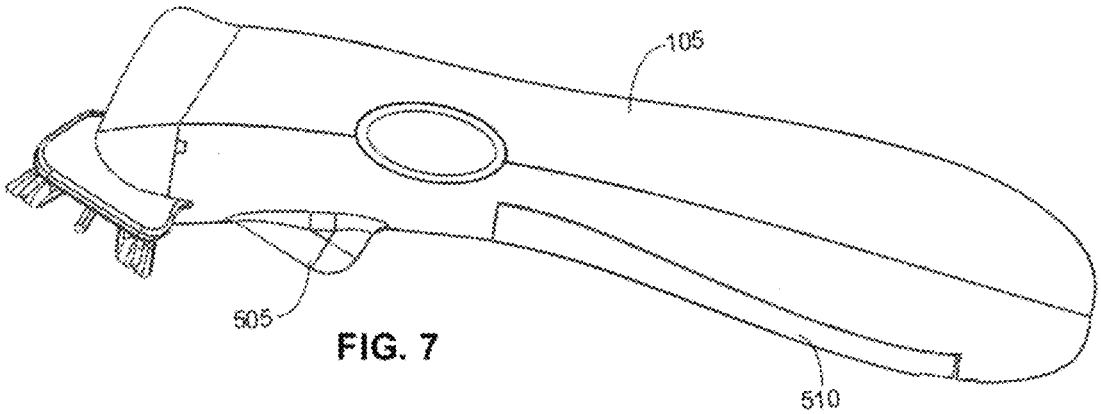
FIG. 7 illustrates a side view of the hair removal apparatus, in accordance with exemplary embodiments of the present invention.
Figure 8:
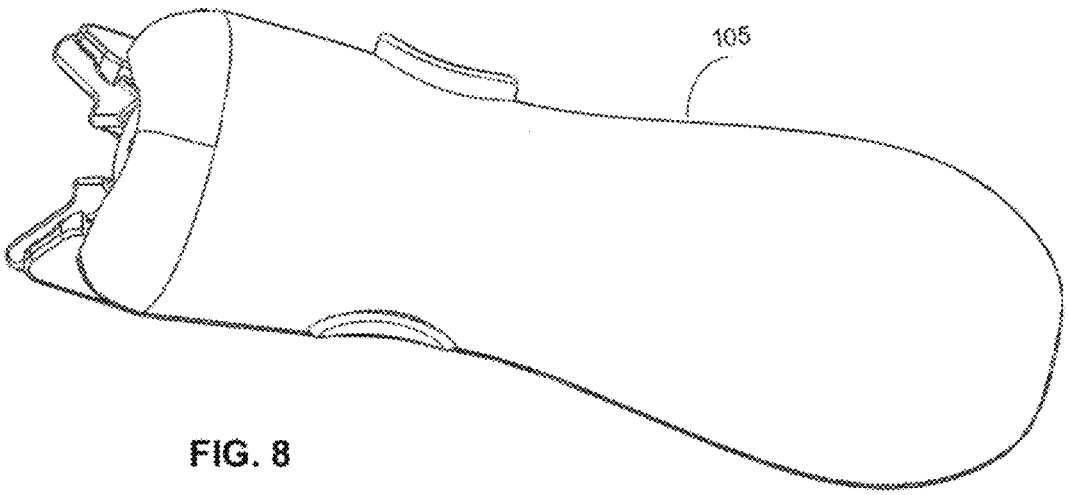
FIG. 8 illustrates a top view of the hair removal apparatus, in accordance with exemplary embodiments of the present invention.

Referring now to FIGS. 7 and 8, there is shown alternative views of the elongated body 105.

It shall be understood that the elongated body 105 can be made of, for example but not limited to, plastic, rubber, silicon, glass, or an admixture thereof.

Further, the hair removal apparatus 100 may further comprise a light source that illuminates through the elongated body 105. The light source may be adapted to illuminate when the hair removal apparatus 100 is turned on and dull when the hair removal apparatus 100 is turned off. The light source will enable a user to better highlight the hair removal region.

From the foregoing, it can be seen that the present invention provides a hair removal apparatus, wherein the motion of the threading member effectively and relatively painlessly engages and removes desired hair.

Embodiments of the present invention can be embodied in other specific forms without departing from the spirit or essential characteristics thereof. Additionally, the specific configurations, choice of materials, and the size and shape of the various elements can be varied according to particular locations of hair removal on the body. Such changes are intended to be embraced within the scope of the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A hair removal apparatus having a top side, a bottom side, a front end, a back end, a left side, and a right side, comprising: an elongated body having a first section including the back end, a middle section, and a second section including the front end, wherein the first section, middle section, and second section have a substantially identical circumference, the elongate body including a light source for illuminating a hair removal region; a cylindrical cartridge defining an indented region, the cylindrical cartridge being removably housed in the middle section such that the cylindrical cartridge may be replaced, wherein the cylindrical cartridge is configured to be snapped into place and secured by two securing elements; a threading member partially wrapped around the indented region of the cylindrical cartridge; and a plurality of threading fingers extending out of an open face of the second section, the plurality of threading fingers including a left pair of threading fingers and a right pair of threading fingers, each of the left and right pairs of threading fingers including a front threading finger and a rear threading finger, the plurality of threading fingers extending downwards away from the bottom side of the hair removal apparatus, the front threading fingers extending forward beyond the front end of the hair removal apparatus, and wherein the plurality of threading fingers accommodate the threading member.

2. The hair removal apparatus of claim 1, wherein the threading member defines a first main loop, a second main loop, and an intertwining section.

3. The hair removal apparatus of claim 2, wherein the first and second main loops are continuous loops.

4. The hair removal apparatus of claim 2, wherein the intertwining section is intertwined about three times to create three substantially symmetrical ovals.

5. The hair removal apparatus of claim 1, wherein the plurality of threading fingers provide tension to the threading member.

6. The hair removal apparatus of claim 1, wherein the threading member is plastic, rubber, cotton, silicon, or combinations thereof.

7. The hair removal apparatus of claim 1, wherein the threading member is coated with a soothing agent.

8. The hair removal apparatus of claim 1, wherein the middle section of the elongated body defines an inwardly extending portion adapted to cooperate with a palm of a hand.

9. The hair removal apparatus of claim 8, wherein the inwardly extending portion comprises an activating member.

10. The hair removal apparatus of claim 1, wherein the elongated body comprises a top half and a bottom half, wherein the top half and the bottom half are detachably attached.

11. The hair removal apparatus of claim 1, further comprising a finger rest disposed on the bottom side of the elongated body.

12. The hair removal apparatus of claim 1, wherein the first section of the elongated body comprises a power supply adapted to propel the threading member.

13. The hair removal apparatus of claim 12, wherein the power supply is at least one battery.

14. The hair removal apparatus of claim 12, wherein propulsion of the threading member is electrically operated.

15. The hair removal apparatus of claim 12, wherein the power supply is manually activated by depressing an activating member.

16. The hair removal apparatus of claim 1, wherein the cylindrical cartridge is adapted to rotate about an axis aligned along a length of the cylindrical cartridge.

17. The hair removal apparatus of claim 1, wherein the elongated body is made of plastic, rubber, silicon, glass, or combinations thereof.

18. A hair removal apparatus having a top side, a bottom side, a front end, a back end, a left side, and a right side, comprising: an elongated body having a first section including the back end, a middle section, and a second section including the front end, wherein the first section, middle section, and second section have a substantially identical circumference; a cylindrical cartridge comprising an indented region and being removably housed in the middle section such that the cylindrical cartridge may be replaced, wherein the cylindrical cartridge is configured to be snapped into place and secured by two securing elements; a threading member partially secured around the indented region of the cylindrical cartridge; and a plurality of threading fingers extending out of an open face of the second section, the plurality of threading fingers including a left pair of threading fingers and a right pair of threading fingers, each of the left and right pairs of threading fingers including a front threading finger and a rear threading finger, the plurality of threading fingers extending downwards away from the bottom side of the hair removal apparatus, the front threading fingers extending forward beyond the front end of the hair removal apparatus, wherein the plurality of threading fingers accommodate the threading member; wherein the threading member defines a first main loop, a second main loop, and an intertwining section, and wherein the intertwining section is intertwined about three times to create three substantially symmetrical ovals.

19. The hair removal apparatus of claim 18, wherein the first section of the elongated body comprises a power supply adapted to propel the threading member.

* * * * *